United States Patent [19]

Ely

[11] Patent Number: 4,556,451

[45] Date of Patent: Dec. 3, 1985

[54] METHOD OF AND APPARATUS FOR SUBSTANTIALLY EQUAL COMPACTING AND DEWATERING OF BOTH FACES OF FRESHLY FELTED PAPER WEB

[75] Inventor: Donald A. Ely, Roscoe, Ill.

[73] Assignee: Beloit Corporation, Beloit, Wis.

[21] Appl. No.: 644,132

[22] Filed: Aug. 22, 1984

Related U.S. Application Data

[63] Continuation of Ser. No. 393,909, Jun. 30, 1982, abandoned, which is a continuation of Ser. No. 217,657, Dec. 18, 1980, abandoned.

[51] Int. Cl.[4] ..... D21F 3/04; D21F 3/08; D21F 3/10

[52] U.S. Cl. ..... 162/205; 162/305; 162/360.1; 29/132; 100/163 R

[58] Field of Search ..... 162/205, 358, 360, 305, 162/306; 29/125, 132; 100/161, 163 R

[56] References Cited

U.S. PATENT DOCUMENTS

| | | | |
|---|---|---|---|
| 2,672,078 | 3/1954 | Hornbostel | 92/49 |
| 3,023,805 | 3/1962 | Walker | 162/358 |
| 3,198,693 | 8/1965 | Justus | 162/272 |
| 3,198,697 | 8/1965 | Justus | 162/372 |
| 3,262,840 | 7/1966 | Hervey | 162/205 |
| 3,268,390 | 8/1966 | Ely, Sr. | 162/306 |
| 3,286,360 | 11/1966 | Walker | 34/23 |
| 4,075,056 | 2/1978 | Ely et al. | 162/360 R |
| 4,086,131 | 4/1978 | Rempel et al. | 162/203 |
| 4,188,262 | 12/1980 | Kankaanpaa | 162/205 |
| 4,197,158 | 4/1980 | Johnson | 162/360 R |

FOREIGN PATENT DOCUMENTS

| | | |
|---|---|---|
| 697774 | 9/1953 | United Kingdom . |
| 1381360 | 1/1975 | United Kingdom . |

*Primary Examiner*—Steve Alvo

*Attorney, Agent, or Firm*—Hill, Van Santen, Steadman & Simpson

[57] ABSTRACT

In a paper making machine dewatering press section substantially equally pressing and dewatering of both faces of a freshly felted paper sheet web is effected by running the web through first press roll means providing a double action first dewatering nip between corunning porous dewatering felts, and successively thereafter running the web through a four roll stack providing second, third and fourth nips without an open paper draw. In the second nip the web is run in dewatering felt engagement with one face of the web, and the opposite face of the web is in direct non-dewatering surface compacting roll engagement in such nip. In the third nip both faces of the web are in direct surface compacting engagement with the non-dewatering press rolls. In the fourth nip, a second dewatering felt runs in engagement with said opposite face of the web and said one face of the web is in non-dewatering surface compacting press roll engagement. The web leaves the press section as a paper sheet having both faces substantially equally compacted and dewatered.

14 Claims, 4 Drawing Figures

METHOD OF AND APPARATUS FOR SUBSTANTIALLY EQUAL COMPACTING AND DEWATERING OF BOTH FACES OF FRESHLY FELTED PAPER WEB

This is a continuation of application Ser. No. 393,909, filed June 30, 1982, now abandoned which is a continuation of application Ser. No. 217,657-filed 12/18/80, now abandoned.

This invention relates to the art of pressing and dewatering freshly felted paper sheet web, and is more particularly concerned with attaining substantially equal ink, size or coating receptivity or absorption on both faces of a paper sheet resulting from such a web without an open paper draw.

Although the art of pressing and dewatering paper web is already rather highly developed, there is still substantial room for improvement.

Prior press sections have suffered from several deficiencies among which may be enumerated undue complexity, excessively long press sections, unequal compacting and felting of the opposite faces of the web, open draws in the press section and requirement for large operating energy expenditure.

Representative of the present state of the art are the following U.S. patents:

- No. 2,672,078—has an open draw for the web and does not attain a plurality of sheet compactions on both faces.
- No. 3,023,805—does not have a sufficient number of pressing nips for high speed pressing and dewatering for at least some paper webs.
- No. 3,262,840—does not attain equal compacting and felting of the paper web.
- No. 3,286,360—does not have equal compacting on both sides of the sheets; has fewer nips than desirable for high speed operation and in the multi-nip arrangement requires excessive machine direction space.
- No. 4,075,056—does not attain a plurality of compactions on each face of the paper web, and has open draws of the paper web.
- No. 4,086,131—does not attain equal compacting and felting of the faces of the web because one face is subjected to extra felt nips.

An important object of the present invention is to overcome the disadvantages, drawbacks, inefficiencies, shortcomings and problems inherent in prior press sections and their operation, and to provide a new and improved press section and method which will attain substantially equal ink, size or coating receptivity or absorption, i.e. compaction, on both faces of a paper sheet resulting from a freshly felted paper sheet web, in a simplified manner, in minimum space, free from open draws in the press section, conserving operating energy, and providing for equal compaction and dewatering of both faces of the sheet.

To this end, the present invention provides in a paper making machine dewatering press section for effecting substantially equal compacting and dewatering of both faces of a freshly felted paper sheet web, first press roll means providing a double action dewatering first nip through which the web passes in engagement between corunning porous dewatering felts, so that both faces of the web are substantially equally pressed and dewatered in such nip; second press roll means comprising a four roll stack providing second, third and fourth nips through which said web runs successively; a dewatering felt running in engagement with one face of said web through said second nip, and the opposite face of said web being in direct press roll non-dewatering compacting engagement in this nip; both faces of said web being in direct non-dewatering compacting engagement with press rolls in said third nip; and a dewatering felt running in engagement with said opposite face of said web in said fourth nip and said one face of said web being in direct non-dewatering compacting press roll engagement in this nip; so that said web leaves said press section as a paper sheet having both faces substantially equally compacted and dewatered and thereby possessed of substantially equal ink, size or coating receptivity or absorption characteristics.

This invention also provides a method of effecting, in a paper making machine dewatering press section, substantially equal compacting and dewatering of both faces of a freshly felted paper sheet web, comprising pressing the web in engagement between corunning porous dewatering felts through a double action dewatering first nip and in such nip substantially equally pressing and dewatering both faces of the web; then running the web successively through second, third, and fourth nips in a second press roll means, and including running a dewatering felt in engagement with one face of said web in said second nip, and in this nip effecting direct press roll non-dewatering web compacting engagement of the opposite face of the web; effecting direct non-dewatering web compacting engagement of both faces of the web with press rolls in the third nip; and running another dewatering felt in engagement with said opposite face of the web in the fourth nip while running said one face of the web in direct press roll non-dewatering web compacting engagement in said fourth nip; so that said web leaves said press section as a paper sheet having both faces substantially equally compacted and dewatered and thereby possessed of substantially equal ink, size and coating receptivity or absorption characteristics.

Other objects, features and advantages of the invention will be readily apparent from the following description of a certain representative embodiment thereof, taken in conjunction with the accompanying drawing although variations and modifications may be effected without departing from the spirit and scope of the novel concepts embodied in the disclosure and in which.

Figure 1:
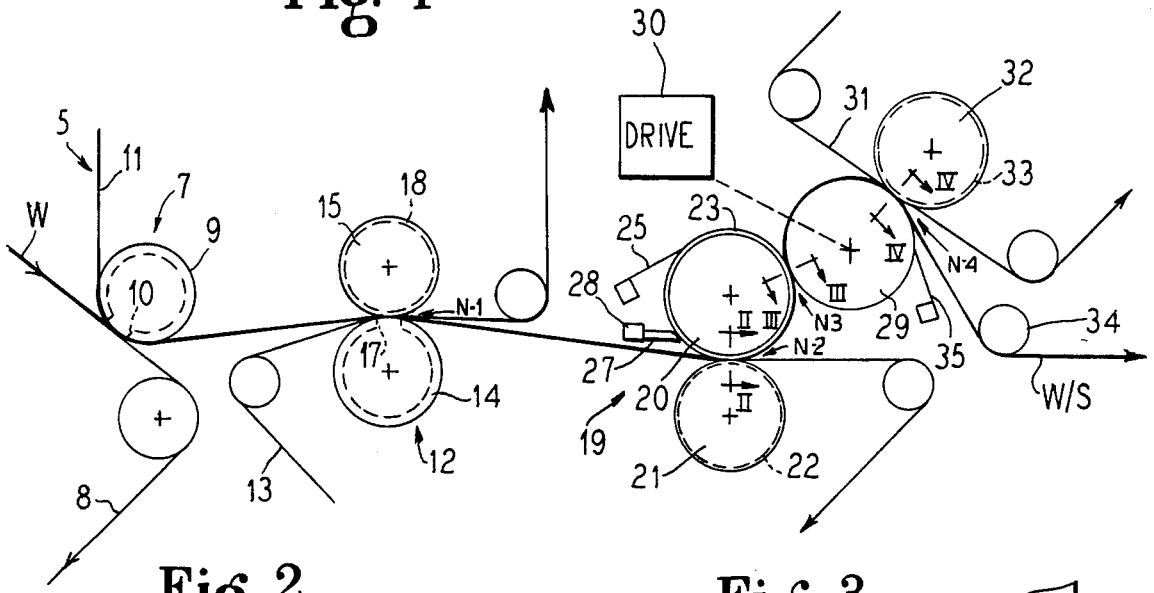
FIG. 1 is a schematic side elevational view of a paper making machine press section embodying the principles of the present invention.

On reference to FIG. 1, a paper making machine dewatering press section 5 in accordance with the present invention includes a pickoff device 7 adapted to be located adjacently downstream from paper web forming means and operating to lift a freshly formed, i.e. felted, paper sheet web W from a forming belt, wire or fabric 8 for further processing in the press section. For this purpose, the pickoff device 7 comprises a pickoff roll 9 equipped with a suction gland 10 and running in engagement with the upper face of an endless belt dewatering felt 11 which is pressed against the web W on the forming fabric 8 at the nip of the roll 9 with the fabric. Suction from the gland 10 causes the web W to separate from the generally upwardly facing forming fabric 8 and adhere to the generally downwardly facing surface of the dewatering felt 11 which carries the web onward to a first press roll means 12.

In first press roll means 12, the dewatering felt 11 runs together with an endless upwardly facing porous dewatering felt 13 with the web W engaged therebetween through a first pressing and dewatering nip N-1 provided by and between a suction roll 14 and a grooved roll 15. In this instance, the suction roll 14 is on the lower side of the nip N-1, and the grooved roll 15 on the upper side of the nip N-1, so that although in the nip itself substantially equal dewatering results through both faces of the web W, the suction provided by a suction device 17 in the roll 14 effects separation of the web W from the upper felt 11 so that the web W can travel onwardly in machine direction carried on top of the lower felt 13, while the felt 11 is guided in a return run to the roll 9. Desirably, the upper press roll 15 may embody a structure substantially according to U.S. Pat. No. 3,198,697, that is, the perimeter of the roll is provided with a set of axially spaced annular grooves 18.

Beyond the nip N-1, the web W is caused to be further pressed and dewatered in second press roll means 19 comprising a four roll stack providing a second nip N-2, a third nip N-3 and a fourth nip N-4, through which the web runs successively.

Figure 2:
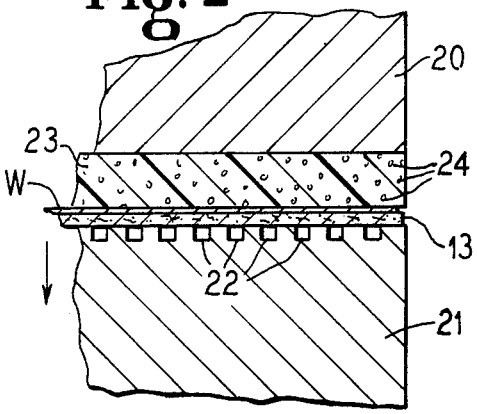
FIG. 2 is an enlarged fragmentary sectional detail view taken substantially along the line II—II of FIG. 1.

The nip N-2 is provided by an upper porous covered web surface compacting non-dewatering press roll 20 and a lower grooved roll 21. In the nip N-2 the dewatering felt 13 engages the grooved roll 21 and the lower face of the web W, and the roll 20 engages the other or upper face of the web. By preference, the grooved roll 21 is similar to the grooved roll 15, having an axially spaced set of circumferential annular grooves 22 (FIG. 2). In addition to facilitating dewatering drainage through the felt 13, the grooves 22 avoid any tendency toward vacuum retention of the web W on the felt 13, so that the web easily releases from the felt 13 at the exit from the nip N-2 for travel on the perimeter of the roll 20 to the nip N-3.

Figure 3:
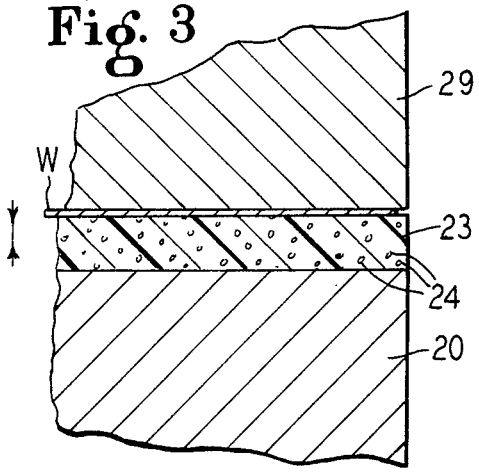
FIG. 3 is a fragmentary enlarged sectional detail view taken substantially along the line III—III of FIG. 1.

For optimum results, the non-dewatering, web surface compacting roll 20 has a relatively thin substantially impermeable elastomer cover on an otherwise solid hard surface roll body as is clearly shown in FIGS. 1–3. In a typical press roll configuration for this purpose, the cover 23 may be about 1" thick where the roll 20 is of 30" to 50" in diameter. The cover 23 is formed from a suitable elastomer in a 5 to 45 P&J hardness range, which enables the pressing perimeter of the roll 20 to yield slightly under web pressing nipping pressure to minimize crushing the paper web fibers. The degree of hardness of the cover 23 can at least to some extent be determined by forming the cover from a closed cell elastomer wherein the size and number of voids 24 in the material of the cover is controlled, employing techniques which are well known in the elastomer fabricating art where in the formulation of the particular elastomer chosen for the intended purpose, a blowing agent or particulate solid material is incorporated in the elastomer matrix and in the finished product substantially unconnected, closed cells are formed or maintained in the finished elastomer body. After the cover 23 has been applied to the roll 20 by whatever technique preferred, the outer perimeter of the cover 23 may be ground off. As noted in FIGS. 2 and 3, some of the voids 24 may then be exposed and provide small pockets which open outwardly at the nipping perimeter of the roll 20 and facilitate operation of the roll 20 by capturing water pressed from the web W and thus serve as a parting agent to facilitate release of the web from the roll 20 after the web passes through the nip N-3. In order to avoid excessive accumulation of water on the perimeter of the roll 20, a doctor 25 acts on the free offrunning perimeter of the roll 20 beyond the nip N-3. If desired, a felt wick 27 may engage the perimeter of the roll 20 either before or after the doctor 25, but preferably after, for applying a web release agent supplied from supply means 28 with which the wick communicates. Instead of the wick 27, a suitable spray device may be used, if preferred. It will be appreciated, of course, that the pressing perimeter of the cover 23 should be of a character to avoid marring the surface of the web W in contact with the roll at the nips N-2 and N-3.

In the nip N-3, the web W which has travelled from the nip N-2 on the perimeter of the roll 20, is substantially equally compacted between the perimeter of the roll 20 and the nipping perimeter of a hard surfaced roll 29. Although the roll 29 may have a plastic cover, it should be of bone hardness and which according to paper machine standards is equivalent to 0–5 P&J hardness. Since the nipping perimeter of the roll 29 is smooth, the softer perimeter of the roll 20, aided by the releasing effect of surface water or releasing agent, will easily permit release of the web W from the perimeter of the roll 20 to follow the perimeter of the roll 29 on the offrunning side of the nip N-3. In a preferred arrangement, the roll 29 may be driven rotatably by suitable drive means 30 and cause driving of the other rolls in the stack in the press means 19.

Figure 4:
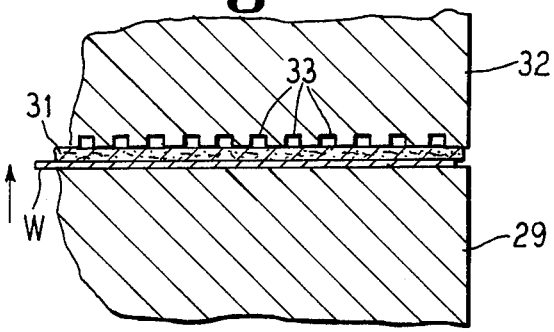
FIG. 4 is an enlarged fragmentary sectional detail view taken substantially along the line IV—IV of FIG. 1.

In the nip N-4, the web W is engaged and compacted on its lower face directly by the perimeter of the hard perimeter roll 29, and on its upper face the web is engaged by a third endless belt dewatering felt 31 which runs through the nip N-4 with the web W and in engagement with the perimeter of a grooved press roll 32 of substantially the same type as the press rolls 15 and 21, and having a set of axially spaced annular peripheral grooves 33 (FIGS. 1 and 4). At the offrunning side of the nip N-4, the web now substantially dewatered and densified leaves the roll 29 and the felt 31 and travels on, as for example, past a guide roller 34 as a sheet W/S which is possessed of substantially equal ink, size or coating receptivity or absorption characteristics.

Since the leading end of the web W on leaving the nip N-4 during threading of the press roll means stack 19 may tend to cling to the perimeter of the roll 29, a doctor blade 35 on the perimeter of the roll 29 adjacent to the offrunning side of the nip N-4 will effect separation of the advancing leading end, which can then be directed about the guide roller 34 and onward to a dryer section, or the like. During normal operation, of course, the doctor 35 is adapted to maintain the perimeter of the roll 29 substantially clean.

As will now be apparent, the substantially equal surface characteristics of the paper sheet W/S leaving the press section 5 results from the substantially equal dewatering and multiple compacting treatment applied to each of the web faces in progressing through the press section and there is no open draw.

In the nip N-1, dewatering is effected through both of the web faces, that is, water is caused to leave through both of the faces and thus both sides of the web are substantially pressed equally.

In the nip N-2, dewatering is effected through the lower face of the web W as indicated by the directional arrow in FIG. 2, while the upper face is not dewatered but is compacted by the perimeter of the roll 20.

On travelling through the nip N-3, the web W is substantially equally compacted by the direct nipping engagement of the rolls 20 and 29 with the opposite faces, as exemplified in FIG. 3 by the double headed arrow.

Then, in the nip N-4, the upper face of the web W is finally dewatered as indicated by directional arrow in FIG. 4, while the lower face of the web is finally compacted by the roll 29.

Therefore, not only is the web W thoroughly densified to provide a strong sheet W/S, but each face of the web is substantially equally multiple compacted so that the desirable equal receptivity or absorption characteristics are attained.

It will be understood that variations and modifications may be effected without departing from the spirit and scope of the novel concepts of the invention.

I claim as my invention:

1. In a paper making machine dewatering press section for effecting substantially equal compacting and dewatering of both faces of a freshly felted paper sheet web without an open paper draw:

first press roll means providing a double action dewatering first nip through which the web passes in engagement between corunning porous dewatering felts, so that both faces of the web are substantially equally pressed and dewatered in said first nip;

second press roll means comprising a four roll stack including a first porous roll and a first non-porous roll forming a second nip, a second non-porous roll forming a third nip with said first non-porous roll, said second non-porous roll having a surface hardness greater than the surface hardness of said first non-porous roll, and a second porous roll forming a fourth nip with said second non-porous roll through which said web runs successively;

a dewatering felt running in engagement with one face of said web and said first porous roll through said second nip, and the opposite face of said web being in direct non-dewatering compacting engagement with said first non-porous roll in said second nip;

both faces of said web being in respective direct non-dewatering compacting engagement with said first and second non-porous rolls in said third nip;

and a dewatering felt running in engagement with said opposite face of said web and said second porous roll in said fourth nip and said one face of said web being in direct non-dewatering compacting engagement with said second non-porous roll in said fourth nip;

so that said web leaves said press section as a paper sheet having both faces substantially equally multiply compacted and dewatered.

2. A press section according to claim 1, wherein said first press roll means comprises a suction roll and a grooved roll in nipping relation.

3. A press section according to claim 1, wherein said first porous roll is a grooved press roll engaging said dewatering felt in said second nip, and said first non-porous roll is a paper web surface compacting press roll having a hard perimeter except for a relatively thin substantially impervious closed cell elastomer cover in a 5 to 45 P&J hardness range engaging directly with the web in said second nip.

4. A press section according to claim 1, wherein said second non-porous roll is a smooth hard-surface web compacting press roll of 0–5 P&J hardness and said first non-porous roll is a web surface compacting press roll having a hard perimeter except for a relatively thin elastomer cover in a 5 to 45 P&J hardness range.

5. A press section according to claim 1, wherein said second non-porous roll is a smooth hard surface roll in direct engagement with the web and said second porous roll is a grooved roll in engagement with said dewatering felt in said fourth nip.

6. A press section according to claim 1, wherein said first press roll means comprise a suction roll and a grooved roll providing said double action dewatering nip; and said first porous roll is a grooved roll and said first non-porous roll is a non-dewatering web surface compacting roll having a hard perimeter except for a relatively thin elastomer cover in a 5 to 45 P&J hardness range, said second non-porous roll is a smooth hard-surface web surface compacting roll of 0–5 P&J nipping surface hardness, and said second porous roll is a grooved press roll.

7. In a paper making machine dewatering and web surface compacting press section for attaining substantially equal ink, size or coating receptivity or absorption on both faces of a paper sheet, without an open paper draw:

a pickoff device located adjacently downstream from paper web forming means and including a downwardly facing first porous dewatering felt and means for separating a freshly formed paper web from a generally upwardly facing forming belt onto said first felt;

an upwardly facing second porous dewatering felt;

first press roll means providing a first pressing and double section dewatering nip through which said first felt and said second felt run together with said web engaged therebetween, and said web then travelling onward on top of said second felt, and said first felt leaving said web;

and second press roll means having (a) a non-porous web surface compacting roll having a hard perimeter except for a relatively thin cover in a 5 to 45 P&J hardness range and a grooved roll providing a second nip through which said second felt and said web run, with said second felt engaging said grooved roll and one face of said web and said covered non-porous web compacting roll directly engaging the other face of said web, (b) a hard surface non-porous roll in a third nip relation to said covered roll having a surface hardness greater than the surface hardness of said thin cover of said compacting roll, and said web travelling on said covered roll from said second nip and then through said third nip and in direct face non-dewatering web surface compacting engagement with said covered and hard surface rolls, (c) another grooved roll in fourth nip relation to said hard surface roll, (d) a third dewatering felt running through said fourth nip in engagement with said another grooved roll, and said web travelling on said hard surface roll and through said fourth nip, with said third felt intervening between said web and said another grooved roll and then separating from and leaving said web which travels on from the press section for further handling;

so that the web leaves said press section as a sheet with both faces substantially equally compacted and dewatered and thereby providing for said substantially equal receptivity and absorption in the paper sheet.

8. A method of effecting, in a paper making machine dewatering press section, substantially equal compacting and dewatering of both faces of a freshly felted paper sheet web, comprising:

(a) pressing the web in engagement between corunning porous dewatering felts through a double action dewatering first nip and in said first nip substantially equally pressing and dewatering both faces of the web;

(b) then running the web successively through second, third and fourth nips in a four roll stack second press, and including:

(c) in said second nip running a dewatering felt in engagement with one face of said web and with a first porous roll, and running an opposite face of said web in direct non-dewatering web compacting engagement with a first non-porous roll;

(d) in said third nip effecting direct non-dewatering web compacting engagement of both faces of the web by running said web between said first non-porous roll and a second non-porous roll having a surface hardness greater than the surface hardness of said first non-porous roll;

(e) and in said fourth nip running another dewatering felt in engagement with said opposite face of the web and a second dewatering roll while running said one face of the web in direct non-dewatering web compacting engagement with said second non-porous roll;

so that said web leaves said press section as a paper sheet having both faces substantially equally compacted and dewatered and thereby possessed of substantially equal ink, size and coating receptivity or absorption characteristics.

9. A method according to claim 8, wherein step (a) is further defined by running said corunning porous dewatering felts in said first press first nip between a suction roll and a grooved roll.

10. A method according to claim 8, wherein step (c) is further defined by engaging the dewatering felt with a grooved press roll and engaging the web directly with an elastomer covered non-porous press roll having a hard perimeter except for a relatively thin closed cell elastomer cover in a 5 to 45 P&J hardness range.

11. A method according to claim 8, wherein step (d) is further defined by running said web in direct engagement between a smooth hard-surface press roll and a non-porous web compacting press roll having a hard perimeter except for a relatively thin cover in a 5 to 45 P&J hardness range.

12. A method according to claim 8, wherein step (e) is further defined by running the web in direct surface-compacting engagement with a smooth hard-surface roll and running said another dewatering felt in engagement with a grooved roll.

13. A method according to claim 8, comprising effecting double action dewatering in said first nip between a suction roll and a grooved roll; and in said second nip running the web between a grooved roll and a non-porous web surface compacting roll having a hard perimeter except for a relatively thin cover in a 5 to 45 P&J hardness range, running the web between a smooth hard surface roll and said non-porous web surface compacting roll in said third nip, and running the web between a grooved press roll cooperating with said hard surface press roll in said fourth nip.

14. In a method of attaining substantially equal ink, size or coating receptivity or absorption on both faces of a paper sheet in a paper making machine dewatering and web surface compacting press section:

picking off freshly formed paper web from a generally upwardly facing forming belt onto a downwardly facing first porous dewatering felt at a location adjacently downstream from paper web forming means;

running said web engaged between said first felt and an upwardly facing second porous dewatering felt through a first pressing and double-action dewatering nip in a first press, and beyond said first nip effecting travel of the web on top of said second felt and separating said first felt from the web;

and then in a second press (a) running said web and said second felt through a second nip between a non-porous web surface compacting roll having a hard perimeter except for a relatively thin cover in a 5 to 45 P&J hardness range, and a grooved roll with said second felt engaging said grooved roll and one face of said web and said web surface compacting roll directly engaging and compacting the other face of said web, (b) effecting travel of said web on said web surface compacting roll from said second nip and through a third nip between said web surface compacting roll and a hard surface roll having a non-porous surface in a 0–5 P&J hardness range and having surface hardness greater than the hardness of said thin cover of said compacting roll and thereby contacting the web directly in web surface compacting engagement with both of said rolls in said third nip, (c) running said web through a fourth nip between said hard surface roll and another grooved roll, (d) in said fourth nip running a third dewatering felt in intervening relation between said web and another grooved roll while said web continues travelling in web surface compacting relation on said hard surface roll, and then beyond said fourth nip effecting separation of the third felt from the web and causing the dewatered and surface compacted web to travel on from the press section for further handling;

so that the web leaves said press section as a sheet with both faces substantially equally compacted and dewatered and thereby providing for said substantially equal receptivity and absorption in the paper sheet.

* * * * *

UNITED STATES PATENT AND TRADEMARK OFFICE

CERTIFICATE OF CORRECTION

PATENT NO. : 4,556,451

DATED : December 3, 1985

INVENTOR(S) : Donald A. Ely

It is certified that error appears in the above-identified patent and that said Letters Patent are hereby corrected as shown below:

Column 6, line 39, please change "double section" to --double action--.

Signed and Sealed this

*Eleventh* Day of *March 1986*

[SEAL]

*Attest:*

DONALD J. QUIGG

*Attesting Officer*

*Commissioner of Patents and Trademarks*